US010762997B2

(12) United States Patent
Park et al.

(10) Patent No.: US 10,762,997 B2
(45) Date of Patent: Sep. 1, 2020

(54) DECONTAMINATION METHOD REDUCING RADIOACTIVE WASTE

(71) Applicant: Korea Atomic Energy Research Institute, Daejeon (KR)

(72) Inventors: Sang Yoon Park, Daejeon (KR); Hui-Jun Won, Daejeon (KR); Seonbyeong Kim, Daejeon (KR); Wangkyu Choi, Daejeon (KR); Mansoo Choi, Seosan-si (KR); Chong-Hun Jung, Daejeon (KR); In-Ho Yoon, Daejeon (KR); JeikWon Moon, Daejeon (KR); Jun Young Jung, Daejeon (KR); Jungsoon Park, Cheongju-si (KR)

(73) Assignee: Korea Atomic Energy Research Institute, Daejeon (KR)

( * ) Notice: Subject to any disclaimer, the term of this patent is extended or adjusted under 35 U.S.C. 154(b) by 473 days.

(21) Appl. No.: 15/712,616

(22) Filed: Sep. 22, 2017

(65) Prior Publication Data

US 2018/0102194 A1 Apr. 12, 2018

(30) Foreign Application Priority Data

Oct. 12, 2016 (KR) ..... 10-2016-0132373

(51) Int. Cl.

| | |
|---|---|
| ***G21F 9/00*** | (2006.01) |
| ***G21F 9/06*** | (2006.01) |
| ***C23G 1/02*** | (2006.01) |
| ***C23G 1/10*** | (2006.01) |
| ***C23G 1/08*** | (2006.01) |

(52) U.S. Cl.

CPC ..... *G21F 9/004* (2013.01); *C23G 1/02* (2013.01); *C23G 1/081* (2013.01); *C23G 1/10* (2013.01); *C23G 1/106* (2013.01); *G21F 9/06* (2013.01)

(58) Field of Classification Search

CPC ... G21F 9/00; G21F 9/004; G21F 9/06; C23G 1/02; C23G 1/081; C23G 1/106

USPC ..... 588/20

See application file for complete search history.

(56) References Cited

U.S. PATENT DOCUMENTS

| | | | | |
|---|---|---|---|---|
| 5,998,690 | A * | 12/1999 | Huang | G21F 9/165 588/10 |
| 9,390,822 | B2 * | 7/2016 | Park | G21F 9/004 |
| 2014/0205052 | A1 * | 7/2014 | Won | C23G 1/02 376/310 |

FOREIGN PATENT DOCUMENTS

| | | | |
|---|---|---|---|
| JP | 2005-004053 | A | 7/2006 |
| JP | 2013-187051 | A | 8/2014 |
| KR | 10-1523763 | B1 | 6/2015 |

* cited by examiner

*Primary Examiner* — Edward M Johnson

(74) *Attorney, Agent, or Firm* — Maier & Maier, PLLC

(57) ABSTRACT

A decontamination method that includes the steps of decontaminating an object containing radioactive contaminated metals or alloys with a chemical decontamination agent including sulfuric acid ($H_2SO_4$) and forming a Ba or Sr precipitate by adding a Ba or Sr cation and a hydroxylion or halogen anion salts to the decontamination waste water.

9 Claims, 4 Drawing Sheets

The mock
decontamination waste water

- Satisfactory cake was generated
- The water content = 35.6%
- Density = 2.56 g/cm$^3$

DECONTAMINATION METHOD REDUCING RADIOACTIVE WASTE

BACKGROUND OF THE INVENTION

1. Field of the Invention

The present invention relates to a decontamination method reducing radioactive waste remarkably and a kit therefor, more precisely to a decontamination method for the primary system of a nuclear power plant.

2. Background

In the process of decontamination of the primary system of a nuclear power plant, an oxidative decontamination agent is not applied in case of a boiling light-water reactor because it can obtain a high decontamination effect even only by reductive decontamination. However, in a pressurized water reactor or a pressurized heavy water reactor, the oxide film contains a large amount of chromium which is difficult to eliminate by reductive decontamination. Therefore, it is necessary to use the oxidative/reductive decontamination agents repeatedly by taking turns.

As an oxidative decontamination agent, nitric permanganate (NP) and alkaline permanganate (AP) have been used. Recently, a new method to add $Cu^{2+}$ to a permanganate solution, in order to prevent erosion of structural materials of the primary system of a nuclear power plant, has been tried (Patent Reference 1). As a reductive decontamination agent, such organic acid complexing agents as oxalic acid, citric acid, picolinic acid, and EDTA (ethylenediaminetetraacetic acid) and their combinations have been used (CITROX, CAN-DECON, CAN-DREM, ORZOX, and CORD). Recently, a new decontamination agent using inorganic acid and $N_2H_4$ as a reducing agent has been developed.

When the oxidative/reductive decontamination processes are repeated to decontaminate the primary system of a pressurized water reactor or a pressurized heavy water reactor, it is required to supply a decontamination agent prepared every time in a fresh solution to the nuclear power system, so that waste generated by the decontamination is significantly increased. Moreover, in the decontamination waste water, not only radioactive materials such as Co-60, Co-58, Co-57, Mn-54, Fe-59, and Zn-65 but also the cations discharged from the lysis of the oxide film such as $Fe^{3+}$, $Cr^{3+}$, and $Ni^{2+}$ and the anions added to control the acidity of the solution are abundant. Therefore, lots of cation exchange resins and anion exchange resins have been used to remove those materials from the waste solution.

CORD decontamination technique applied to the most power plants in the world is efficient in reducing waste but has a problem of generating a large amount of waste ion exchange resin after the decontamination process. When Obrigheim power plant in the total system volume of 160 $m^3$ was decontaminated, 6.7 $m^3$ of waste ion exchange resin was generated. When 4-loop Stabde power plant in the total system volume of 310 $m^3$ was decontaminated, 1.4 $m^3$ of waste ion exchange resin was generated. Other than CORD decontamination technique, in the commercialized methods using organic acids such as EDTA, picolinic acid, formic acid, and citric acid, much more waste ion exchange resin was generated. In the case of CITROX decontamination technique, which is used as RCP decontamination technique in Korea, 0.42 $m^3$ of waste ion exchange resin is generated after the decontamination process when the volume of a decontamination solution is 1 $m^3$.

In addition, ion exchange resins are used to purify the primary and the secondary system water and nuclear fuel storage water in a pressurized water reactor. To purify the primary coolant in the 1,000 MVe pressurized water reactor, 5~10 $m^3$ of waste ion exchange resin is generated annually. Also, to purify the secondary coolant, 10~15 $m^3$ of waste ion exchange resin is generated annually. And, to purify nuclear fuel storage water, 4~8 $m^3$ of waste ion exchange resin is generated annually. The waste ion exchange resin generated from the normal operation of a nuclear power plant and after the decontamination thereof is not properly treated yet. A technique following the standard of the waste treatment including compressive strength, immersion, and leaching tests of the waste form has been studied and reducing waste ion exchange resin is a big issue in power plants.

Thus, the present inventors have developed a technique capable of minimizing the decontamination waste solution by repeatedly applying the oxidative/reductive decontamination process several times even when the decontamination process water is added only once in the decontamination of the primary system of a nuclear power plant.

PRIOR ART REFERENCE

Patent Reference (Patent Reference 1) Korean Patent No. 10-1523763

SUMMARY OF THE INVENTION

It is an object of the present invention to provide a method to treat decontamination waste water generated in the course of decontamination of radioactive contaminated objects, more specifically objects containing radioactive contaminated metals or alloys generated in nuclear power plants.

It is another object of the present invention to provide a decontamination method to reduce the amount of ion exchange resin used in the process of treating decontamination waste water and a kit for the same.

It is also an object of the present invention to provide a novel decontamination treatment apparatus for treating the decontamination waste water generated in a process of decontaminating the radioactive contaminated object generated in a nuclear power plant.

To achieve the objects above, the present invention provides a decontamination method comprising the following steps:

decontaminating an object containing radioactive contaminated metals or alloys with a chemical decontamination agent comprising sulfuric acid ($H_2SO_4$) (step 1); and forming a Ba or Sr precipitate by adding Ba or Sr cation and hydroxyl ion or halogen anion salts to the decontamination waste water generated in step 1 (step 2).

According to the decontamination method of the present invention, once the precipitate is formed, an additional step of separating the precipitate from the remaining decontamination waste water can be included.

The present invention also provides a kit for decontamination including a chemical decontamination agent comprising sulfuric acid ($H_2SO_4$) to decontaminate an object containing radioactive contaminated metals or alloys; and Ba or Sr cation and hydroxyl ion or halogen anion salts to be added to the decontamination waste water to form a precipitate.

By using the decontamination method according to the present invention, the waste generated from the decontamination of the primary system of a nuclear power plant can be significantly reduced; the accumulation of waste ion exchange resin can be prevented in a nuclear power plant because the main waste is formed into a sludge cake with high water solubility; and the efficiency and economy of decontamination can be increased since the costs for the treatment of waste is remarkably reduced.

BRIEF DESCRIPTION OF THE DRAWINGS

The application of the preferred embodiments of the present invention is best understood with reference to the accompanying drawings, wherein.

DETAILED DESCRIPTION

Hereinafter, the present invention is described in detail.

The decontamination method of the present invention is described hereinafter.

The decontamination method of the present invention comprises the following steps:

decontaminating an object containing radioactive contaminated metals or alloys with a chemical decontamination agent comprising sulfuric acid ($H_2SO_4$) (step 1); and forming a Ba or Sr precipitate by adding Ba or Sr cation and hydroxyl ion or halogen anion salts to the decontamination waste water generated in step 1 (step 2).

In the decontamination method according to the present invention, an additional step of separating the precipitate from the residual decontamination waste water (step 3) might be included after the precipitate is formed.

The decontamination method or the decontamination treatment in this invention includes a process of treating the waste solution generated during or after the decontamination.

Figure 1:
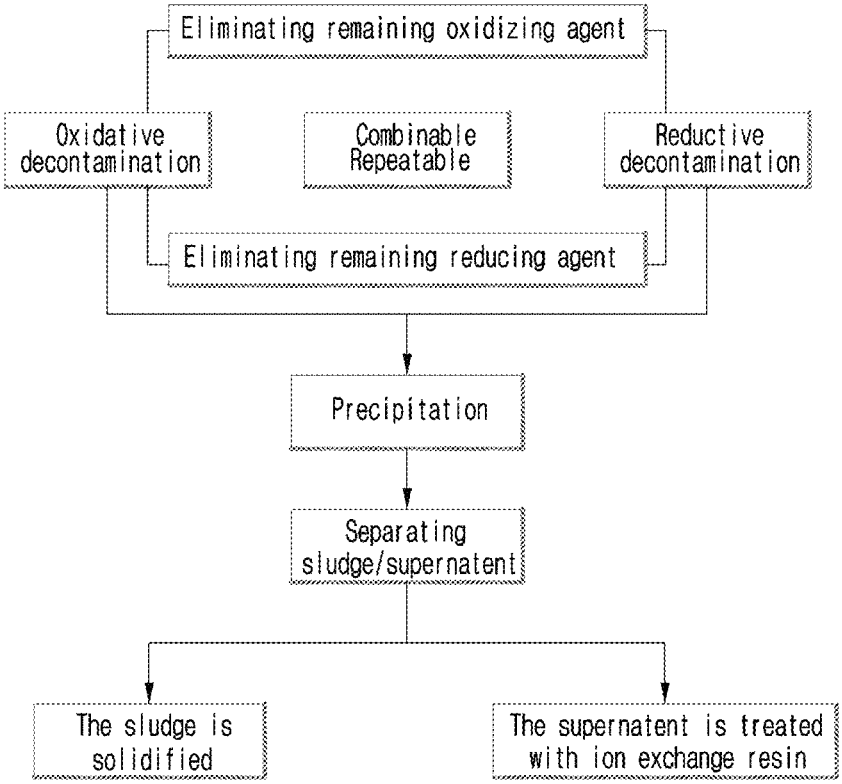
FIG. 1 is a flow chart illustrating the procedure of the decontamination method of the present invention.

FIG. 1 is a flow chart illustrating the procedure of the decontamination method of the present invention. Hereinafter, the decontamination method of the present invention is described in more detail.

In the meantime, the decontamination method according to the present invention can be performed directly within a nuclear power plant system where there is an object containing radioactive contaminated metals or alloys or performed in a separated system to which an object containing radioactive contaminated metals or alloys is moved out of the original system.

Step 1 of the decontamination method of the invention is described hereinafter.

The chemical decontamination agent of step 1 of the method of the invention can be an oxidative decontamination agent or a reductive decontamination agent or a combined decontamination agent of them. If the chemical decontamination agent is the combined decontamination agent of the oxidative/reductive decontamination agent, the combination is made with the repeats of the oxidative decontamination agent and the reductive decontamination agent, in that order or vice versa, by taking their turns.

That is, the step of decontaminating an object containing radioactive contaminated metals or alloys with a chemical decontamination agent includes the following sub-steps:

decontaminating an object using an oxidative decontamination agent alone;

decontaminating an object using a reductive decontamination agent alone;

decontaminating an object using an oxidative decontamination agent first and then using a reductive decontamination agent;

decontaminating an object using a reductive oxidative decontamination agent first and then using an oxidative decontamination agent;

decontaminating an object by performing the cycle of using an oxidative decontamination agent first and then using a reductive decontamination agent at least twice or three times; and decontaminating an object by performing the cycle of using a reductive decontamination agent first and then using an oxidative decontamination agent at least twice or three times.

In the decontamination process, the number of repeats is not limited in order to get a necessary decontamination effect, and in general it can be up to 5 times, 4 times, three times, or two times.

In the decontamination treatment in step 1, when the cycle is repeated, the system water necessary for each decontamination process can be repeatedly used after filled in once or can be added separately to each decontamination process.

When the system water is supplied once and repeatedly used for the decontamination using the repeated cycles of using an oxidative decontamination agent and a reductive decontamination agent in turns, the step of eliminating the remaining oxidizing agent or reducing agent left after each decontamination process can be additionally included.

For example, in order to eliminate the remaining oxidizing agent left after each decontamination process using an oxidative decontamination agent, hydrazine ($N_2H_4$) can be added thereto.

To eliminate the remaining reducing agent left after each decontamination process using a reductive decontamination agent, peroxide ($H_2O_2$) can be added thereto.

The remaining oxidizing agent such as potassium permanganate can be decomposed and eliminated by inducing the reaction shown in the reaction formula 1 below by adding hydrazine ($N_2H_4$).

$$4KMnO_4+5N_2H_4+6H_2SO_4 \rightarrow 4K^+ + 4Mn^{2+} + 5N_2 + 16H_2O + 6SO_4^{2-} \quad \text{[Reaction Formula 1]}$$

The remaining reducing agent such as hydrazine can be decomposed and eliminated by inducing the reaction shown in the reaction formula 2 below by adding hydrogen peroxide ($H_2O_2$).

$$2H_2O_2+N_2H_4 \rightarrow N_2+4H_2O \quad \text{[Reaction Formula 2]}$$

In the decontamination method of the present invention, the object containing radioactive contaminated metals or alloys is generated in the inside of the nuclear power plant system.

At this time, the nuclear power plant herein includes light water moderated reactor, boiling water reactor (BWR), pressurized water reactor (PWR), vodo-vodyanoi energetichesky reactor (VVER), heavy water reactor (HWR), pressurized heavy water reactor (PHWR), CANDU (Canada Deuterium Uranium), gas-cooled heavy water reactor, graphite-moderated reactor Magnox, advanced gas-cooled reactor (AGR), high-temperature gas-cooled reactor, reaktor bolshoy moshchnosti kanalniy (RBMK), and pebble bed modular reactor, but not always limited thereto. Herein, the nuclear power plant is preferably pressurized water reactor or pressurized heavy water reactor.

The system herein can be the primary system, but not always limited thereto.

In the decontamination method of the present invention, the metal or alloy in step 1 is one or more materials selected from the group consisting of stainless steel, inconel steel, and zirconium alloy, but not always limited thereto.

The object herein includes a material generated during the operation of a nuclear power plant or during the process of disassembly after a lapse of the operation period.

The object containing the metal or alloy can include a coolant pump, a pressurizer, a steam generator, a vapor discharge pipe, a water supply pipe, and a moderator container, etc.

In this invention, the chemical decontamination agent of step 1 can be an oxidative decontamination agent including an oxidizing agent and a metal ion.

At this time, the oxidizing agent includes permanganic acid, chromic acid, dichromic acid, or the salts thereof, and preferably includes chromic acid or its salt, and more preferably can be selected from the group consisting of $KMnO_4$, $NaMnO_4$, $H_2CrO_4$ and $HMnO_4$.

The oxidizing agent can be one or more agents selected from the group consisting of $KMnO_4$, $NaMnO_4$ and $HMnO_4$.

Preferably, the oxidizing agent can be $HMnO_4$.

The metal ion above can be one or more metal ions selected from the group consisting of $Cu^{2+}$, $Fe^{3+}$, $Cr^{3+}$, $Ni^{2+}$ and $Zn^{2+}$, and $Cu^{2+}$ is more preferred.

The potential of an object, that is a metal or alloy part to which an oxidative decontamination agent is applied, can be moved to the passive area by adding the metal ion, resulting in the effective prevention of erosion of the part to be decontaminated using oxidation.

In the decontamination using an oxidative decontamination agent according to the present invention, the concentration of the oxidizing agent can be $1\times10^{-5}$ M~$1\times10^{-2}$ M. If the concentration of the oxidizing agent is less than $1\times10^{-5}$ M, oxidation cannot be fully induced. If the concentration of the oxidizing agent is more than $1\times10^{-2}$ M, it may take a lot of chemicals to decompose the oxidizing agent after the oxidative decontamination.

In the decontamination using an oxidative decontamination agent according to the present invention, the concentration of sulfuric acid can be $1\times10^{-3}$ M~$3\times10^{-2}$ M. If the concentration of sulfuric acid is less than $1\times10^{-3}$ M, the effect of decontamination is not enough. If the concentration of sulfuric acid is more than $3\times10^{-2}$ M, a large amount of a neutralizing agent is required to neutralize the excessive sulfuric acid, which can accelerate erosion.

In the decontamination using an oxidative decontamination agent according to the present invention, if the metal ion is $Cu^{2+}$ or $Zn^{2+}$, the concentration of the metal ion can be $2\times10^{-5}$ M~$2\times10^{-3}$ M, but not always limited thereto and any adjustment can be made by those in the art as long as the decontamination effect is obtained. If the concentration of $Cu^{2+}$ or $Zn^{2+}$ is less than $2\times10^{-5}$ M, the potential cannot be properly controlled to move to the passive area. If the concentration of $Cu^{2+}$ or $Zn^{2+}$ is more than $2\times10^{-3}$ M, a metal precipitate can be generated.

Further, in the decontamination using an oxidative decontamination agent according to the present invention, if the metal ion is neither $Cu^{2+}$ nor $Zn^{2+}$, the concentration of metal ion can be $2\times10^{-6}$ M~$2\times10^{-5}$ M, and can be adjusted by those in the art as long as the decontamination effect is obtained. If the concentration of the metal ion is less than $2\times10^{-6}$ M, the potential cannot be properly controlled to move to the passive area. If the concentration of the metal ion is more than $2\times10^{-5}$ M, a metal precipitate can be generated.

Also, pH of the oxidative decontamination agent in this invention can be 1.5~4.8, but not always limited thereto and can be adjusted as long as the decontamination effect is obtained. If the pH is less than 1.5, erosion of a metal part can be an issue and if the pH is more than 4.8, the effect of oxidative decontamination can be reduced. However, the pH range can be changed by those in the art as long as the decontamination effect is obtained.

The oxidative decontamination agent in this invention can be prepared by the following steps:

preparing a solution by dissolving an oxidizing agent in distilled water (step 1);

adding sulfuric acid to the solution prepared in step 1 (step 2); and adding a metal ion to the solution added with sulfuric acid in step 2 (step 3).

Hereinafter, the method for preparing the oxidative decontamination agent above is described in more detail.

First, in the method for preparing the oxidative decontamination agent of the invention, step 1 is to prepare a solution by dissolving an oxidizing agent in distilled water.

The oxidizing agent in step 1 can be $KMnO_4$, $NaMnO_4$, $H_2CrO_4$, and $HMnO_4$, and the concentration of the oxidizing agent to be dissolved in distilled water is between $1.0\times10^{-5}$ M~$1.0\times10^{-2}$ M, but not always limited thereto.

Next, in the method for preparing the oxidative decontamination agent of the invention, step 2 is to add sulfuric acid to the solution prepared in step 1.

The concentration of the sulfuric acid added in step 2 is $1\times10^{-3}$ M~$3\times10^{-2}$ M, but not always limited thereto.

The sulfuric acid added in step 2 plays a role in regulating pH of the oxidative decontamination agent and is able to control pH in the range of 1.5~4.8. However, the present invention is not limited to that range.

Next, in the method for preparing the oxidative decontamination agent of the invention, step 3 is to add a metal ion to the solution containing sulfuric acid prepared in step 2.

The metal ion of step 3 can be $Cu^{2+}$, $Fe^{3+}$, $Cr^{3+}$, $Ni^{2+}$ or $Zn^{2+}$. If the metal ion is $Cu^{2+}$ or $Zn^{2+}$, the concentration of the metal ion is preferably $2\times10^{-5}$ M~$2\times10^{-3}$ M. If the metal ion is neither $Cu^{2+}$ nor $Zn^{2+}$, the concentration of the metal ion is $2\times10^{-6}$ M~$2\times10^{-5}$ M, but not always limited thereto.

The metal ion in step 3 can be added in the form of each ion or an ion pair by adding a metal salt. At this time, the metal salt is a metal salt in which a metal cation and an anion are combined.

The anion at this time can be an anion of organic acid such as $NO^{3-}$, $S_2^-$, $SO_4^{2-}$, $CO_3^{2-}$, $HSO_4^-$, $HCO_3^-$, and acetic acid and a halide ion, but not always limited thereto.

The temperature and time at which the oxidative decontamination method of the invention is performed are not particularly limited, but the method can be performed at 70□~110□.

In this invention, the chemical decontamination agent of step 1 can be a reductive decontamination agent including a reducing agent and a metal ion.

At this time, the reducing agent can be one or more agents selected from the group consisting of $NaBH_4$, $H_2S$, $N_2H_4$, and $LiAlH_4$, and the metal ion above can be one or more metal ions selected from the group consisting of $Ag^+$, $Ag^{2+}$, $Mn^{2+}$, $Mn^{3+}$, $Co^{2+}$, $Co^{3+}$, $Cr^{2+}$, $Cr^{3+}$, $Cu^+$, $Cu^{2+}$, $Mn^{2+}$, $Mn^{3+}$, $Sn^{2+}$, $Sn^{4+}$, $Ti^{2+}$, and $Ti^{3+}$.

Further, in the reductive decontamination agent above, the reducing agent can be $N_2H_4$ or $LiAlH_4$ and the metal ion can be $Cu^+$ or $Cu^{2+}$, or the reducing agent can be $N_2H_4$ and the metal ion can be $Cu^{2+}$.

In the decontamination using a reductive decontamination agent according to the present invention, the concentration of the reducing agent is $5\times10^{-4}$ M~0.5 M. If the concentration of the reducing agent is less than $5\times10^{-4}$ M, the reduction is not fully induced. If the concentration of the reducing agent is more than 0.5 M, a large amount of a chemical is necessary to decompose the excessive reducing agent after the decontamination process.

In the decontamination using a reductive decontamination agent according to the present invention, the concentration of the reductive metal ion therein is preferably $1\times10^{-5}$ M~0.1 M. If the concentration of the reductive metal ion is less than $1\times10^{-5}$ M, the effect of decontamination can be decreased. If the concentration of the reductive metal ion is higher than 0.1 M, a metal precipitate can be generated Further, in the decontamination using a reductive decontamination agent according to the present invention, the concentration of sulfuric acid is preferably $1\times10^{-4}$ M~0.5 M. If the concentration of sulfuric acid is less than $1\times10^{-4}$ M, the effect of decontamination can be decreased. If the concentration is higher than 0.5 M, a large amount of a neutralizing agent is required to neutralize the excessive sulfuric acid.

In the meantime, pH of the reductive decontamination agent above can be regulated in the range of 1.0~3.7 according to the purpose of the decontamination. If the pH is lower than 1.0, a metal material can be eroded. If the pH is higher than 3.7, the effect of decontamination can be decreased.

The reductive decontamination agent in this invention can be prepared by the following steps:

preparing a solution by dissolving a reducing agent in distilled water (step 1);

adding sulfuric acid to the solution prepared in step 1 (step 2); and adding a metal ion to the solution added with sulfuric acid in step 2 (step 3).

Hereinafter, the method for preparing the reductive decontamination agent above is described in more detail step by step.

First, in the method for preparing the reductive decontamination agent of the invention, step 1 is to prepare a solution by dissolving a reducing agent in distilled water.

The reducing agent of step 1 can be selected among the reducing agents well known to those in the art, and more specifically one or more reducing agents selected from the group consisting of $NaBH_4$, $H_2S$, $N_2H_4$, and $LiALH_4$. The concentration of the reducing agent to be dissolved in distilled water is between $5\times10^{-4}$ M~0.5 M, which can be adjusted in the range with which those in the art can take out the decontamination effect.

Next, in the method for preparing the reductive decontamination agent of the invention, step 2 is to add sulfuric acid to the solution prepared in step 1.

The concentration of the sulfuric acid added in step 2 is preferably $1\times10^{-4}$ M~0.5 M.

The sulfuric acid added in step 2 plays a role in regulating pH of the reductive decontamination agent and is able to control pH in the range of 1.0~3.7.

Next, in the method for preparing the reductive decontamination agent of the invention, step 3 is to add a reductive metal ion to the solution containing sulfuric acid prepared in step 2.

The reductive metal ion of step 3 can be one or more metal ions selected from the group consisting of $Ag^+$, $Ag^{2+}$, $Mn^{2+}$, $Mn^{3+}$, $Co^{2+}$, $Co^{3+}$, $Cr^{2+}$, $Cr^{3+}$, $Cu^+$, $Cu^{2+}$, $Mn^{2+}$, $Mn^{3+}$, $Sn^{2+}$, $Sn^{4+}$, $Ti^{2+}$, and $Ti^{3+}$, and the concentration thereof is $1\times10^{-5}$ M~0.1 M. However, the range of the reductive metal ion concentration can be changed by those in the art as long as the decontamination effect is not harmed.

The metal ion in step 3 can be added in the form of each ion or an ion pair by adding a metal salt.

For example, the anion of the metal salt above can be $Cl^-$, $NO^{3-}$, or $SO_4^{2-}$, but not always limited thereto.

The temperature and time at which the reductive decontamination method of the invention is performed are not particularly limited, but the method can be performed at 70 □~140□.

Step 2 of the method of the invention is described in more detail hereinafter.

In this invention, any precipitant that includes Ba or Sr cations to form a precipitate with sulfuric acid ions ($SO_4^{2-}$) existing in the waste solution can be added to the waste solution. That is, any salt that can be dissolved in the waste solution and thus provide Ba or Sr cations thereto can be used. However, such salts that have a too low solubility in the waste solution, like the expected precipitate $BaSO_4$ or $SrSO_4$, are not preferred.

As an anion capable of forming a salt with the Ba or Sr cation, a hydroxide ion or a halogen anion can be selected. The halogen anion includes fluoro anion, chloro anion, bromo anion, and iodo anion. If the halogen anion is used, an additional process to separate the halogen anion from the waste solution after the precipitation is necessary.

The precipitate in step 2 can be the co-precipitate formed together with a radioactive material or metal ion in the decontamination waste water.

Such metal ions generated during the decontamination process are co-precipitated together with $BaSO_4$ or $SrSO_4$ in the waste solution, and by this co-precipitation, the amount of metal ions that is necessarily to be eliminated by using ion exchange resin from the decontamination waste water would be significantly reduced.

At this time, the metal ion can be one or more metal ions selected from the group consisting of $Fe^{3+}$, $Ni^{2+}$, $Zn^{2+}$, $Ag^+$, $Ag^{2+}$, $Mn^{2+}$, $Mn^{3+}$, $Co^{2+}$, $Co^{3+}$, $Cr^{2+}$, $Cr^{3+}$, $Cu^+$, $Cu^{2+}$, $Mn^{2+}$, $Mn^{3+}$, $Sn^{2+}$, $Sn^{4+}$, $Ti^{2+}$, and $Ti^{3+}$, and more preferably selected from the group consisting of $Fe^{3+}$, $Cr^{3+}$, and $Ni^{2+}$.

The radioactive material above can be one or more radioactive materials selected from the group consisting of Co-60, Co-58, Co-57, Mn-54, Fe-59, and Zn-65.

In this invention, the precipitate of step 2 is formed upon completion of step 1 by adding a precipitant such as $Ba(OH)_2$ or $Sr(OH)_2$ at an equal or similar concentration to $SO_4^{2-}$ remaining in the waste solution.

When a precipitate is formed by the reaction of the reaction formula 3 below, it is co-precipitated with a radioactive material or a metal ion.

$$H_2SO_4+Ba(OH)_2=BaSO_4\downarrow+2H_2O \quad \text{[Reaction Formula 3]}$$

In the course of precipitation, such metal ions dissolved in the oxide film as $Fe^{3+}$, $Cr^{3+}$, and $Ni^{2+}$; such radioactive materials as Co-60, Co-58, Co-57, Mn-54, Fe-59, and Zn-65; and such metal ions included in the decontamination solution as $Mn^{2+}$, $Cu^{2+}$, and $Cu^{+}$ can be eliminated from the supernatant by at least 90%, 95%, 99%, or 99.9% by the co-precipitation with $BaSO_4$.

The mixing process of a precipitant with the decontamination waste water is performed by using the conventional mixing tool, for example by using an in-line-mixer, and at this time Reynolds number is 10,000~50,000.

The temperature in the mixer used above can be determined by those in the art considering the expected mixing effect. For example, the temperature can be selected such that mixing can occur within a range of Reynolds numbers, and more preferably the temperature can be 25□~80□.

The calculation of Reynolds number is achieved by the mathematical formula 1 below.

$$Re=S\ V\ \rho/\mu \qquad \text{[Mathematical Formula 1]}$$

(Re=Reynolds number, S=Pipe surface area, V=Flow velocity (cm/sec), ρ=Flow density (g/cm$^3$), μ=Viscosity (g/cm sec))

The decontamination method of the present invention can additionally include another step of separating the precipitate above from the decontamination waste water (step 3).

In this invention, once a precipitate is formed and the metal ion and the radioactive material are co-precipitated in the decontamination waste water, the precipitate can be separated and eliminated from the decontamination waste water.

At this time, the precipitate may have the form of a solid or a sludge, which includes a precipitate or a co-precipitated precipitate comprising a metal ion and a radioactive material The separation of a solid precipitate above or a sludge composed of a metal ion and a radioactive material from the residual decontamination waste water can be accomplished by various separation methods including those using a filter paper, a separation membrane, and a filter, etc. The tool used for the separation can be a paper, a polymer, a ceramic, a metal, or a complex thereof. For example, a separation filter can be sued for the separation above, and more specifically a candle filter can be used.

The moisture content of the cake made by solid-liquid separation by a candle filter is up to 40%, 30%, 20%, or 10%.

The density of the cake made above is 0.1~10 g/cm$^3$, 1~5 g/cm$^3$, or 2~3 g/cm$^3$, and is preferably 2.56 g/cm$^3$ in an example of the invention, but not always limited thereto.

The method for discarding the cake formed above can be one of various radioactive waste treatment methods. As an example, the cake is directly loaded in a radioactive waste drum, wherein it is solidified to be wasted, but the method is not always limited thereto.

The concentration of a metal ion and a radioactive material in the solution remaining after the precipitation process of the radioactive material and the metal ion in the decontamination waste water is preferably up to 10%, 5%, 1%, or 0.1% by the amount before the precipitation process. Compared with the conventional method to eliminate a radioactive material and a metal ion by using ion exchange resin, the method of the invention is more effective in reducing total waste including waste ion exchange resin and sludge cake up to ⅕ by the conventional method.

Therefore, according to the decontamination method of the present invention, the waste ion exchange resin generated in a nuclear power plant, specifically in the primary system of a pressurized water reactor and a pressurized heavy water reactor, can be reduced by 1/100, and other waste can be also reduced to ⅕ by the waste produced from the conventional process. The main waste is formed as the form of a sludge cake having a high disposal facility solubility, so that the accumulation of waste ion exchange resin is not caused in the nuclear power plant and the waste treatment costs can be reduced by ⅕, suggesting that the method of the invention has a high decontamination efficiency and is very economical.

The present invention also provides a kit comprising a decontamination agent for the decontamination method and a precipitant for the precipitation. Hereinafter, the kit is described in more detail.

The present invention provides a kit for decontamination including a chemical decontamination agent comprising sulfuric acid ($H_2SO_4$) to decontaminate an object containing radioactive contaminated metals or alloys; and Ba or Sr cation and hydroxyl ion or halogen anion salts to be added to the decontamination waste water to form a precipitate.

The description about the techniques of the decontamination method of the present invention is also applied to the description of the kit.

The chemical decontamination agent herein can be provided as produced or provided together with another kit to prepare a chemical decontamination agent.

In this invention, the chemical decontamination agent of the kit for decontamination can be an oxidative decontamination agent containing an oxidizing agent and a metal ion. The kit can be composed of an oxidizing agent, a metal ion, and sulfuric acid.

The oxidative decontamination agent of the present invention can be prepared according to the description above.

In this invention, the chemical decontamination agent of the kit for decontamination can be a reductive decontamination agent containing a reducing agent and a metal ion. The kit can be composed of a reducing agent, a metal ion, and sulfuric acid.

The reductive decontamination agent of the present invention can be prepared according to the description above.

The present invention provides an apparatus to perform the decontamination method of the present invention. The description about the decontamination method above can be applied to the apparatus herein.

The apparatus to perform the decontamination method of the present invention comprises a decontamination processing part to decontaminate an object containing radioactive contaminated metals or alloys by using a chemical decontamination agent comprising sulfuric acid; a storage part to store the decontamination waste water generated in the decontamination processing part; a precipitant supply part to store a precipitant which is the salt of Ba or Sr cation and hydroxyl ion or halogen anion and to provide the precipitant thereafter in order to form a precipitate; and a precipitate forming part to form a precipitate after mixing the decontamination waste water and the precipitant above.

The precipitate forming part in the apparatus above comprises a mixing section to mix the decontamination waste water and the precipitant and a settling tank where the precipitate is growing.

The precipitation can start in the mixing section, and the precipitate can grow in the settling tank.

The apparatus above can additionally include a separation part to separate the precipitate grown in the precipitate forming part from the residual waste solution. The separation part includes a separation tool or method to separate a solid or a sludge type precipitate from the residual waste solution. At this time, the separation process can be achieved by using various tools such as a filter paper, a separation membrane, and a filter, and herein the separation tools can be a paper, a polymer, a ceramic, a metal, or a complex thereof. For example, a separation filter can be sued for the separation above, and more specifically a candle filter or a filter press can be used.

Figure 2:
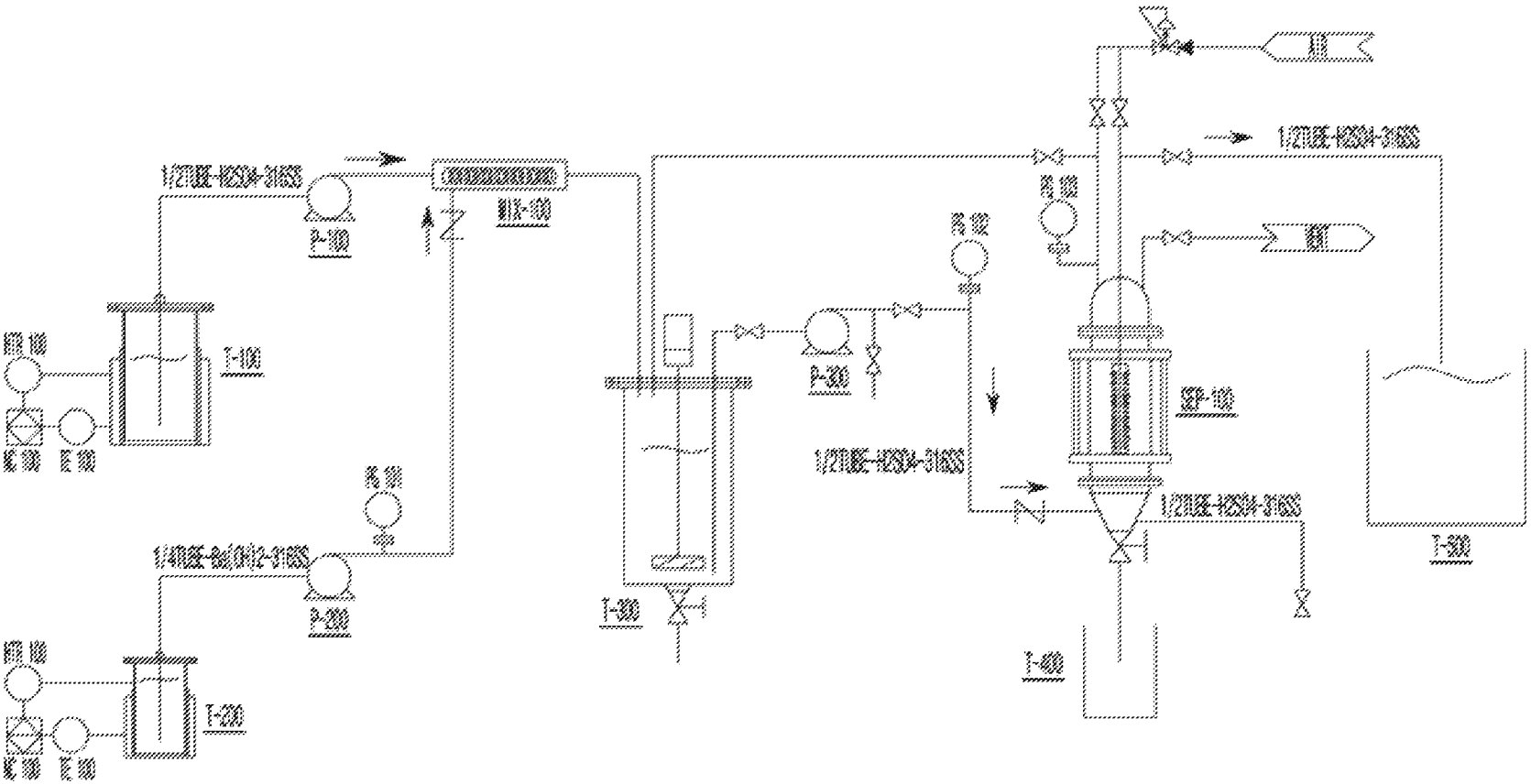
FIG. 2 is a diagram illustrating the decontamination treatment apparatus of the present invention for treating decontamination waste water.

FIG. 2 illustrates an example of the apparatus according to the present invention, wherein the composition of the apparatus to separate a solid or a sludge type precipitate from the decontamination waste water generated in the decontamination processing part after the decontamination process is illustrated.

The decontamination waste water containing radioactive materials and various ions is supplied to MIX-100 (Line Mixer) from T-100 by P-100 (metering pump). The precipitate stored in T-200, for example $Ba(OH)_2$ solution (the temperature of this solution can be 60~80° C.), is also supplied to MIX-100 by P-200 (metering pump) at a constant rate. MIX-100 provides Reynolds number in the range of 10,000~50,000 which will be sufficient to induce $BaSO_4$ precipitation. In T-100, a relative low Reynolds number of up to 500 is provided to grow the precipitate particles. Once the precipitate particles are fully grown, the solution containing the sludge is supplied to SEP-100 (candle filter) by P-300 (metering pump) to deliver the sludge, where the solid-liquid separation is efficiently accomplished so as to form a cake from the sludge.

The generated cake is directly loaded in T-400, the radioactive waste drum, to form a cement waste form. The filtered water is stored in the storage container T-500 or re-used in the decontamination process.

Practical and presently preferred embodiments of the present invention are illustrative as shown in the following Examples.

However, it will be appreciated that those skilled in the art, on consideration of this disclosure, may make modifications and improvements within the spirit and scope of the present invention.

EXAMPLE 1

Elimination of Metal Ions and Anions According to the Decontamination Method of the Present Invention Decontamination and decontamination waste water treatment were performed in order to eliminate the metal ions and anions included in the decontamination waste water generated from the decontamination of the invention.

The mock decontamination waste water to be the target of the decontamination waste water treatment was prepared.

The mock decontamination waste water was prepared by adding an oxidative decontamination agent, an oxidative decontamination agent decomposer, a reductive decontamination agent, and a reductive decontamination agent decomposer stepwise to the solution containing 0.35 mM of $Fe^{3+}$, 0.24 mM of $Cr^{3+}$, and 0.21 mM of $Ni^{2+}$ according to the procedure described in FIG. 1.

The composition and the concentration of the added decontamination agent and the decontamination agent decomposer are as follows.

Oxidative decontamination agent: 6.5 mM $KMnO_4$+3.25 mM $H_2SO_{4+0.5}$ mM $Cu^{2+}$ Oxidative decontamination agent decomposer: 8.1 mM $N_2H_4$+9.8 mM $H_2SO_4$ Reductive decontamination agent: 50 mM $N_2H_4$+30 mM $H_2SO_4$ Reductive decontamination agent decomposer: 100 mM $H_2O_2$ Next, 43 mM of $Ba(OH)_2$ precipitate was added to the mock decontamination waste water prepared under the condition described hereinbefore, resulting in the precipitation of $BaSO_4$ to induce the co-precipitation of metal ions and anions included in the mock decontamination waste water.

In this example, the reaction of the decontamination waste water was induced according to the condition described above, precisely 4 different reactions were induced with different reaction temperatures, loop flow rates, reactor stirring speeds, and $Ba(OH)_2$ feed rates.

Each example performed according to the different reaction conditions is described in examples <1-1>~<1-4>.

All the examples were performed for 1 hour and the reaction system was simulated the functions of T-100, T-200, P-100, P-200, MIX-100, and T-300. The reactions were performed in a small loop containing 1 liter reactor.

EXAMPLE 1-1

The reaction to eliminate metal ions and anions from the decontamination waste water was induced under the reaction conditions as described below.

Reaction temperature: 70□;
Loop flow rate for the first 30 minutes: 640 ml/min;
Loop flow rate for the last 30 minutes: 208 ml/min;
Stirring speed for the first 30 minutes: 250 RPM;
Stirring speed for the last 30 minutes: 100 RPM; and
Barium hydroxide feed rate: 17 ml/min;

EXAMPLE 1-2

The reaction to eliminate metal ions and anions from the decontamination waste water was induced under the reaction conditions as described below.

Reaction temperature: 25□;
Loop flow rate for the first 30 minutes: 205 ml/min;
Loop flow rate for the last 30 minutes: 205 ml/min;
Stirring speed for the first 30 minutes: 100 RPM;
Stirring speed for the last 30 minutes: 100 RPM; and
Barium hydroxide feed rate: 6.2 ml/min;

EXAMPLE 1-3

The reaction to eliminate metal ions and anions from the decontamination waste water was induced under the reaction conditions as described below.

Reaction temperature: 70□;
Loop flow rate for the first 30 minutes: 205 ml/min;
Loop flow rate for the last 30 minutes: 205 ml/min;
Stirring speed for the first 30 minutes: 100 RPM;
Stirring speed for the last 30 minutes: 100 RPM; and
Barium hydroxide feed rate: 6.2 ml/min;

EXAMPLE 1-4

The reaction to eliminate metal ions and anions from the decontamination waste water was induced under the reaction conditions as described below.

Reaction temperature: 25□;
Loop flow rate for the first 30 minutes: 640 ml/min;
Loop flow rate for the last 30 minutes: 207 ml/min;
Stirring speed for the first 30 minutes: 250 RPM;
Stirring speed for the last 30 minutes: 100 RPM; and
Barium hydroxide feed rate: 17 ml/min;

EXAMPLE 2

Elimination of Radioactive Materials According to the Decontamination Method of the Present Invention The following experiment was performed to eliminate radioactive materials from the decontamination waste water by using the decontamination method using the precipitation process of the present invention.

In this example, the decontamination target was the sample with the radioactive contaminated oxide film. The radioactive contaminated sample was collected from the primary system of Hanul nuclear power plant II Unit 3 (pressurized water reactor). The sample was in the shape of a tube whose inner diameter was 1.9 cm and the length was 60 cm. The inside of the tube sample was contaminated with such radioactive materials as Co-60, Co-58, Co-57, Mn-54, Fe-59, and Zn-65.

The sample with the radioactive contaminated oxide film was loaded in the decontamination apparatus, and the decontamination was conducted. The decontamination apparatus is an apparatus capable of performing the functions of FIG. 1, which facilitates the decontamination agent input, heating, circulation, and monitoring the decontamination process.

At this time, the decontamination steps and the decontamination waste water treatment steps are as described below.

The radioactive contaminated sample was decontaminated by the processes shown in FIG. 1, which were oxidative decontamination agent input, oxidative decontamination agent decomposer input, reductive decontamination agent input, and reductive decontamination agent decomposer input.

At this time, the composition and the concentration of the added decontamination agent and the decontamination agent decomposer are as follows.

Oxidative decontamination agent: 6.5 mM $KMnO_4$+3.25 mM $H_2SO_4$+0.5 mM $Cu^{2+}$ Oxidative decontamination agent decomposer: 8.1 mM $N_2H_4$+9.8 mM $H_2SO_4$ Reductive decontamination agent: 50 mM $N_2H_4$+30 mM $H_2SO_4$ Reductive decontamination agent decomposer: 100 mM $H_2O_2$ First, potassium permanganate ($KMnO_4$), sulfuric acid ($H_2SO_4$), and $Cu^{2+}$ were added to the radioactive contaminated target sample, followed by reaction at 90~95° C. for 8~12 hours at the pH range of 1.7~2.4.

Next, hydrazine ($N_2H_4$) was added thereto to ionize the residual oxidizing agent potassium permanganate and sulfuric acid.

Then, hydrazine ($N_2H_4$), sulfuric acid ($H_2SO_4$), and $Cu^{2+}$ were added thereto, followed by reaction at 95° C. for 8~12 hours at the pH range of 2.8~3.2.

Hydrogen peroxide ($H_2O_2$) was added thereto, followed by reaction at 60~80° C. for 30 minutes ~1 hour at pH 11 to convert the residual reducing agent into water and nitrogen.

The oxidative decontamination and the reductive decontamination processes were repeated 3~5 times. Then, $Ba(OH)_2$ was added thereto to induce the formation of a precipitate and thereby to induce the co-precipitation with the radioactive materials therein.

Finally, the sludge and solution generated after the precipitate was formed were separated using a candle filter.

COMPARATIVE EXAMPLE 1

$HMnO_4$-2000 ppm Oxalic Acid (OA) Contamination Method

As the conventional method for the comparison, $HMnO_4$-OA decontamination method was used.

At this time, the concentration of the decontamination agent used for the $HMnO_4$-OA decontamination method was as follows.

Oxidative decontamination agent: 6.5 mM $HMnO_4$

Oxidizing agent decomposing solution: 16.25 mM $H_2C_2O_4$+13 mM $HNO_3$

Reductive decontamination agent: 22.2 mM $H_2C_2O_4$

Reducing agent decomposing solution: 22.2 mM $H_2O_3$

COMPARATIVE EXAMPLE 2

$KMnO_4$-CITROX Contamination Method

As the conventional method for the comparison, $KMnO_4$-CITROX decontamination method was used.

At this time, the concentration of the decontamination agent used for the $KMnO_4$-CITROX decontamination method was as follows.

Oxidative decontamination agent: 6.5 mM $HMnO_4$

Oxidizing agent decomposing solution: 16.25 mM $H_2C_2O_4$+13 mM $HNO_3$

Reductive decontamination agent: 22.2 mM $H_2C_2O_4$

Reducing agent decomposing solution: 22.2 mM $H_2O_2$

EXPERIMENTAL EXAMPLE 1

Elimination of Metal Ions, Anions, and Decontamination Agent According to Example 1 of the Present Invention The concentrations of metal ions, anions, and decontamination agent in the waste solution before and after the precipitation according to the addition of Ba precipitant in example 1 were calculated and the results are shown in Table 1 below.

TABLE 1

| | | Metal ion conc., ppm | | | | | | | Decontamination agent conc., ppm | |
|---|---|---|---|---|---|---|---|---|---|---|
| | Precipitation | Fe | Cr | Ni | Cu | Ba | K | Mn | $SO_4$ | $N_2H_4$ |
| Example 1-1 | Before precipitation | 24 | 24 | 12 | 32 | 5819 | 247 | 348 | 3500 | 1440 |
| | After precipitation | 0.003 | 0.007 | 0.003 | 0.034 | 23 | 109 | 0.172 | 4 | 0.592 |

TABLE 1-continued

| | Precipitation | Metal ion conc., ppm | | | | | | | Decontamination agent conc., ppm | |
|---|---|---|---|---|---|---|---|---|---|---|
| | | Fe | Cr | Ni | Cu | Ba | K | Mn | $SO_4$ | $N_2H_4$ |
| Example 1-2 | Before precipitation | 24 | 24 | 12 | 32 | 5819 | 247 | 348 | 3500 | 1440 |
| | After precipitation | 0.001 | 0.001 | 0.001 | 0.005 | 103 | 119 | 0.104 | 4 | 0.89 |
| Example 1-3 | Before precipitation | 24 | 24 | 12 | 32 | 5819 | 260 | 351 | 3500 | 1360 |
| | After precipitation | 0.001 | 0.008 | 0.003 | 0.007 | 35 | 147 | 0.012 | 4 | 0.862 |
| Example 1-4 | Before precipitation | 24 | 24 | 12 | 32 | 5819 | 228 | 341 | 3600 | 1440 |
| | After precipitation | 0.001 | 0.001 | 0.001 | 0.005 | 40 | 111 | 0.021 | 8 | 0.72 |
| Mean concentration of chemical components in the solution before precipitation, ppm | | 24 | 24 | 12 | 32 | 5819 | 246 | 347 | 3525 | 1420 |
| Mean concentration of chemical components in the solution after precipitation, ppm | | 0.002 | 0.004 | 0.002 | 0.013 | 50.25 | 121.5 | 0.077 | 5 | 0.766 |
| Removal rate by precipitation, % | | 99.99 | 99.98 | 99.98 | 99.96 | 99.14 | 50.51 | 99.98 | 99.86 | 99.95 |

As shown in Table 1, it was confirmed that at least 99.9% of the primary waste dissolved out of the oxide film of an object containing radioactive contaminated metals or alloys, such as $Fe^{3+}$, $Cr^{3+}$, and $Ni^{2+}$ were eliminated by being co-precipitated in the precipitate, in the course of the chemical decontamination according to the present invention.

The secondary waste generated from the chemical decontamination agent such metal ions as $Cu^{3+}$ and $Mn^{2+}$ was also eliminated at least 99.9% by being included in the precipitate.

However, $K^+$ was eliminated only up to 50%, suggesting that an ion exchange resin was necessary to eliminate the residual $K^+$ ions.

Figure 3:
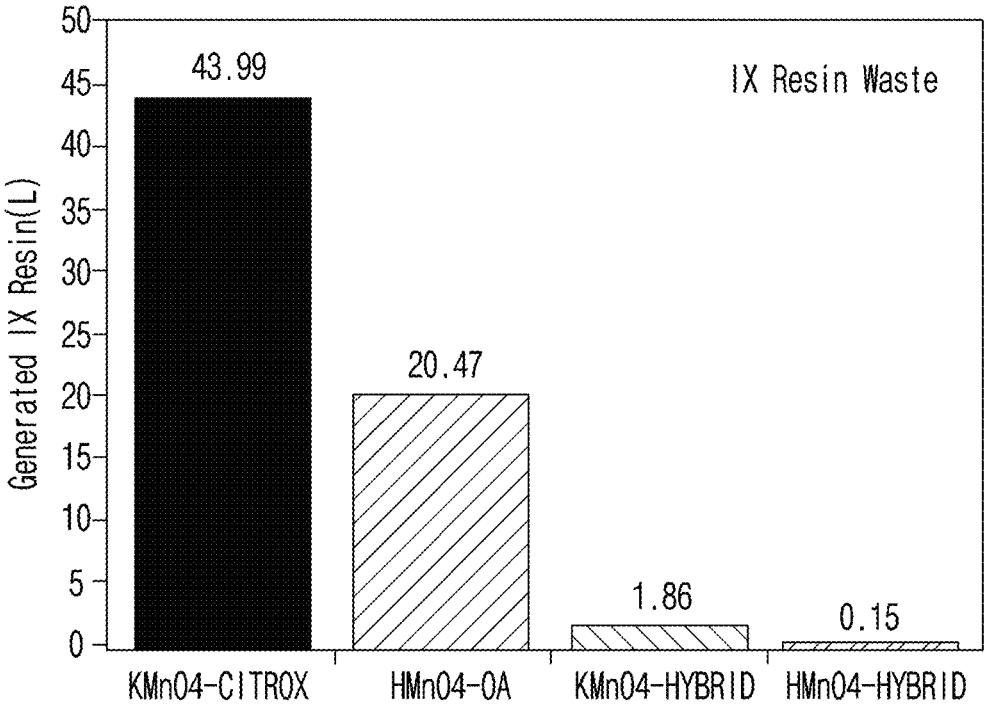
FIG. 3 is a graph illustrating the comparison of the amount of resin generated during the decontamination of the reactor coolant pump in the domestic nuclear power plant pressurized water reactor by the $KMnO_4$-HYBRID method and the $HMnO_4$-HYBRID method according to the present invention.
Figure 4:
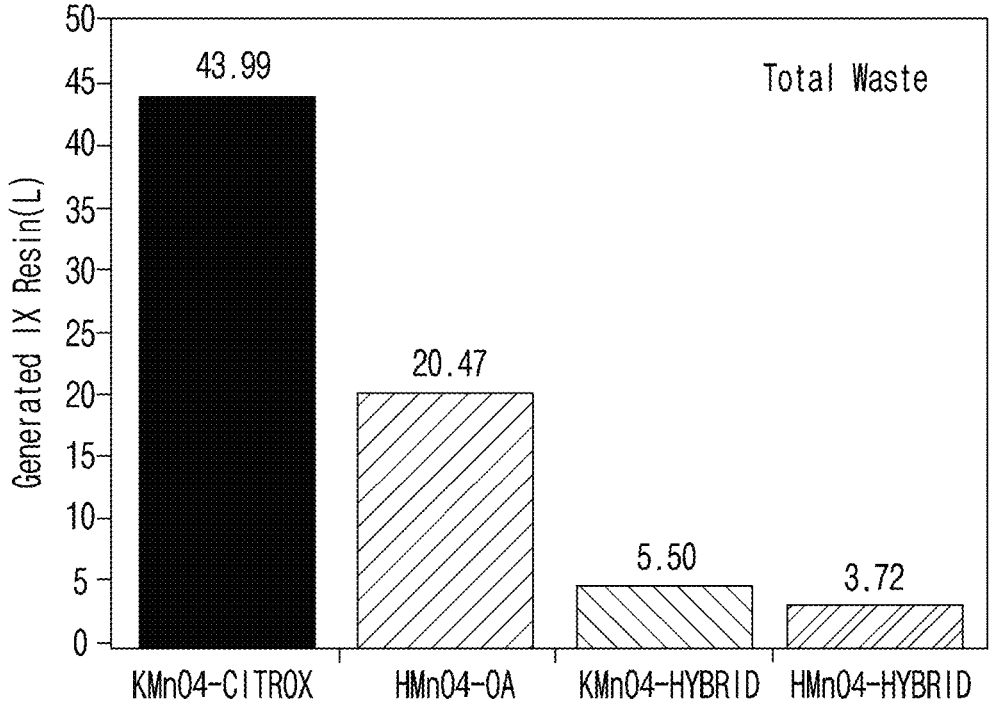
FIG. 4 is a graph illustrating the comparison of the total amount of waste generated during the decontamination of the reactor coolant pump in the domestic nuclear power plant pressurized water reactor by the $KMnO_4$-HYBRID method and the $HMnO_4$-HYBRID method according to the present invention.

From the results above, it was confirmed that if $HMnO_4$ is used as an oxidative decontamination agent instead of $KMnO_4$, the removal rate of $K^+$ ion would be increased, indicating that the generation of waste ion exchange resin could be reduced (FIGS. 3 and 4).

EXPERIMENTAL EXAMPLE 2

Elimination of Radioactive Materials According to Example 2 of the Present Invention 20 cc of the waste solution was taken before and after example 2, followed by nuclide analysis using MCA (multichannel analyzer). The results are shown in Table 2 below.

TABLE 2

| Nuclide | Before precipitation (Bq/g) | After precipitation (Bq/g) | Removal rate |
|---|---|---|---|
| Mn-54 | 183.25 | ND | 100% |
| Co-57 | 15.43 | ND | 100% |
| Co-58 | 1508.00 | 0.68 | >99.9% |
| Fe-59 | 4.38 | ND | 100% |
| Co-60 | 308.06 | ND | 100% |
| Zn-65 | 3.57 | ND | 100% |

Before the precipitation, many radioactive materials such as Co-60, Co-58, Co-57, Mn-54, Fe-59, and Zn-65 were detected. However, after the precipitation, only up to 0.1% Co-58 was detected but none of other radioactive materials such as Co-60, Co-57, Mn-54, Fe-59, and Zn-65 were detected.

EXPERIMENTAL EXAMPLE 3

Comparison of Waste Production Between the Decontamination Waste Water Treatment Method Using the Conventional Ion Exchange Resin and the Decontamination Waste Water Treatment Method Using the Precipitation Process According to the Present Invention The following experiment was performed to compare the waste production between the decontamination waste water treatment method using the conventional ion exchange resin and the decontamination waste water treatment method using the precipitation process according to the present invention.

Particularly, the amount of waste generated from the decontamination method of the invention was calculated and compared with the amount of waste generated from the decontamination method using the conventional ion exchange resin.

The decontamination using the conventional ion exchange resin herein was performed with $HMnO_4$-OA method (comparative example 1) and $KMnO_4$-CITROX method (comparative example 2).

In comparative examples, the concentrations of metal ions and anions included in the decontamination waste water generated from the method of the invention and from the method of comparative example were investigated and the results are shown in Table 3 below.

At this time, the initial concentration of each was calculated theoretically with considering the conditions of the decontamination agent in each decontamination method.

TABLE 3

| | | $K^+$ | $Mn^{2+}$ | $Cu^{2+}$ | $Fe^{3+}$ | $Cr^{3+}$ | $Ni^{2+}$ | $Ba^{2+}$ | $SO_4^{2-}$ | $C_2O_4^{2-}$ | $NO_3^-$ | $C_6H_5O_7^{3-}$ |
|---|---|---|---|---|---|---|---|---|---|---|---|---|
| KMnO4 HYBRID | Initial conc (mM) | 6.5 | 6.5 | 0.49 | 0.35 | 0.24 | 0.21 | 36.4 | 36.4 | 0 | 0 | 0 |
| | Residual conc (mM) | 3.25 | 0.01 | 0 | 0 | 0 | 0 | 0.04 | 0.04 | 0 | 0 | 0 |
| HMnO4 HYBRID | Initial conc (mM) | 0 | 6.5 | 0.49 | 0.35 | 0.24 | 0.21 | 36.4 | 36.4 | 0 | 0 | 0 |
| | Residual conc (mM) | 0 | 0.01 | 0 | 0 | 0 | 0 | 0.04 | 0.04 | 0 | 0 | 0 |
| $HMnO_4$ OA | Initial conc (mM) | 0 | 6.5 | 0 | 0.35 | 0.24 | 0.21 | 0 | 0 | 22.2 | 13 | 0 |
| | Residual conc (mM) | 0 | 6.5 | 0 | 0.35 | 0.24 | 0.21 | 0 | 0 | 0 | 13 | 0 |
| $KMnO_4$ CITROX | Initial conc (mM) | 6.5 | 6.5 | 0 | 0.35 | 0.24 | 0.21 | 0 | 0 | 22.2 | 13 | 6.7 |
| | Residual conc (mM) | 6.5 | 6.5 | 0 | 0.35 | 0.24 | 0.21 | 0 | 0 | 0 | 13 | 6.7 |

The amount of ion exchange resin necessary for the complete elimination of the primary waste metal ions and the secondary waste anions from the waste solution was calculated by using the ion concentration listed in Table 3. The results are shown in table 4 below.

At this time, according to $KMnO_4$-HYBRID method and $HMnO_4$-HYBRID method, the removal rate of each ion was assumed to be equal to that of example 1.

TABLE 4

| | HMnO4-HYBRID | KMnO4-HYBRID | $HMnO_4$-OA | $KMnO_4$-CITROX |
|---|---|---|---|---|
| Cationic resin (L/cycle) | 0.08 | 1.79 | 7.81 | 11.23 |
| Anionic resin (L/cycle) | 0.07 | 0.07 | 12.66 | 32.76 |
| Total ionic resin (L/cycle) | 0.15 | 1.86 | 20.47 | 43.99 |
| Cake (L/cycle) | 3.6 | 3.6 | 0.00 | 0.00 |

TABLE 4-continued

| | HMnO4-HYBRID | KMnO4-HYBRID | $HMnO_4$-OA | $KMnO_4$-CITROX |
|---|---|---|---|---|
| Total waste (L/cycle) | 3.72 | 5.50 | 20.47 | 43.99 |

Figure 5:
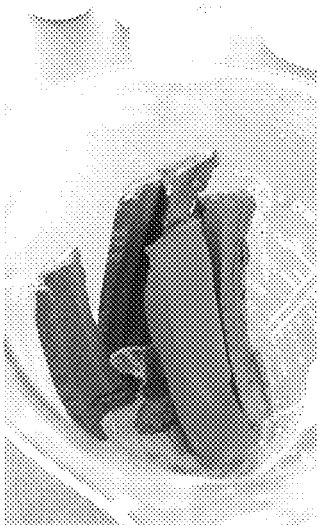
FIG. 5 is a diagram illustrating the example of solid-liquid separation by the candle filter of the present invention.

As shown in FIG. 5, the volume of a precipitate cake was measured with the cake of the mock decontamination waste solution collected by using a candle filter. The water content was 35.6% and the cake density was 2.56 g/cm$^3$, based on which the total volume of the cake was calculated as follows.

In the course of $BaSO_4$ precipitation, if it is assumed that all of $MnO_2$, $Fe(OH)_3$, $Cr(OH)_3$, and $Ni(OH)_2$ are 100% precipitated and KOH is precipitated together up to 50%, the concentration of the total precipitate is 9326 ppm. At this time, the volume of the decontamination agent is 1 m$^3$, so the weight of the precipitate is 9326 g. The precipitate was separated by solid-liquid separation by using a candle filter and the density of the cake was measured. As a result, the density was 2.56 g/cm$^3$ as shown in FIG. 5. Thus, the volume of the cake generated from the methods of $HMnO_4$-HYBRID and $KMnO_4$-HYBRID was 3.6 L (9326/(2.56/1000)).

FIG. 3 is a graph illustrating the amounts of waste ion exchange resin generated according to the 4 different decontamination methods shown in Table 4.

As shown in the graph of FIG. 3, the amount of waste ion exchange resin generated from the method of $HMnO_4$-HYBRID was up to 1/100 (0.3 and 0.7%) by those generated from the method of $KMnO_4$-CITROX or $HMnO_4$-OA. And the amount of waste ion exchange resin generated from the method of $KMnO_4$-HYBRID was up to 1/10 by those generated from the method of $KMnO_4$-CITROX or $HMnO_4$-OA.

FIG. 4 is a graph illustrating the comparison of the amount of total waste including the precipitate cake generated from the methods of $KMnO_4$-HYBRID and $HMnO_4$-HYBRID.

From the comparative examples, it was confirmed that the amount of total waste generated from the method of $KMnO_4$-HYBRID or $HMnO_4$-HYBRID provided by the present invention was ¼~⅕ by the amount of total waste generated from the conventional method using ionic resin, suggesting that the generation of waste could be significantly reduced by the method of the present invention.

BRIEF DESCRIPTION OF THE MARK OF DRAWINGS

T-100: decontamination waste water tank
T-200: $Ba(OH)_2$ storage tank
T-300: particle growing & settling tank
T-500: purified water storage tank
SEP-100: candle filter
MIX-100: line mixer Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended Claims.

What is claimed is:

1. A decontamination method comprising the following steps:

decontaminating an object containing radioactive contaminated metals or alloys with a chemical decontamination agent comprising sulfuric acid ($H_2SO_4$) (step 1);

forming a Ba or Sr precipitate by adding Ba or Sr cation and hydroxyl ion or halogen anion salts to a decontamination waste water generated in step 1 (step 2); and separating the precipitate and a supernatant after being treated with an ion exchange resin(step 3 ), wherein the Ba or Sr cations in step 2 form the precipitate with sulfuric acid ions ($SO_4^{2-}$), and the precipitate is co-precipitated with radioactive materials and metal ions included in the decontamination waste water.

2. The decontamination method according to claim 1, wherein the chemical decontamination agent of step 1 is an oxidative decontamination agent, a reductive decontamination agent, or a combined decontamination agent thereof.

3. The decontamination method according to claim 1, wherein the decontamination method additionally includes a step of separating the precipitate (step 3).

4. The decontamination method according to claim 2, wherein the oxidative decontamination agent includes an oxidizing agent and a metal ion.

5. The decontamination method according to claim 4, wherein the oxidizing agent is one or more agents selected from the group consisting of $KMnO_4$, $NaMnO_4$, $H_2CrO_4$, and $HMnO_4$.

6. The decontamination method according to claim 2, wherein the reductive decontamination agent includes a reducing agent and a metal ion.

7. The decontamination method according to claim 6, wherein the reducing agent is one or more agents selected from the group consisting of $NaBH_4$, $H_2S$, $N_2H_4$, and $LiAlH_4$.

8. The decontamination method according to claim 1, wherein the object containing radioactive contaminated metals or alloys in step 1 is generated from the inner system of a nuclear power plant.

9. The decontamination method according to claim 1, wherein the metal or alloy in step 1 is one or more materials selected from the group consisting of stainless steel, inconel steel, and zirconium alloy.

* * * * *